US010720687B2

(12) United States Patent
Penttilä et al.

(10) Patent No.: US 10,720,687 B2
(45) Date of Patent: Jul. 21, 2020

(54) RADIO FREQUENCY FILTER

(71) Applicant: Tongyu Technology Oy, Oulu (FI)

(72) Inventors: Janne Penttilä, Pattijoki (FI); Tero Kämäräinen, Tupos (FI)

(73) Assignee: Tongyu Technology Oy, Oulu (FI)

( * ) Notice: Subject to any disclaimer, the term of this patent is extended or adjusted under 35 U.S.C. 154(b) by 38 days.

(21) Appl. No.: 16/081,997

(22) PCT Filed: Mar. 17, 2017

(86) PCT No.: PCT/FI2017/050181
§ 371 (c)(1),
(2) Date: Sep. 4, 2018

(87) PCT Pub. No.: WO2017/158242
PCT Pub. Date: Sep. 21, 2017

(65) Prior Publication Data

US 2019/0181524 A1 Jun. 13, 2019

(30) Foreign Application Priority Data

Mar. 18, 2016 (CN) ..... 2016 1 0157721

(51) Int. Cl.

| | |
|---|---|
| ***H01P 1/205*** | (2006.01) |
| ***H01P 1/208*** | (2006.01) |
| ***H01P 7/04*** | (2006.01) |
| ***H01P 1/207*** | (2006.01) |

(52) U.S. Cl.
CPC ..... *H01P 1/2053* (2013.01); *H01P 1/207* (2013.01); *H01P 1/208* (2013.01); *H01P 7/04* (2013.01)

(58) Field of Classification Search
CPC .... H01P 7/04; H01P 7/06; H01P 1/208; H01P 1/205; H01P 1/2053; H01P 1/207
USPC ..... 333/203, 206–209, 222, 223, 227
See application file for complete search history.

(56) References Cited

U.S. PATENT DOCUMENTS

| | | | | |
|---|---|---|---|---|
| 4,425,555 | A | 1/1984 | Meguro et al. | |
| 4,567,454 | A * | 1/1986 | Saito | H01P 1/2053 333/206 |
| 4,725,798 | A | 2/1988 | Sadao | |
| 5,680,080 | A | 10/1997 | Taiyo et al. | |
| 5,969,585 | A | 10/1999 | Nishiyama et al. | |
| 6,731,960 | B2 | 5/2004 | Abdelmonem | |

(Continued)

FOREIGN PATENT DOCUMENTS

| | | | |
|---|---|---|---|
| CN | 1348618 | A | 5/2002 |
| JP | 62120703 | A1 | 6/1987 |

OTHER PUBLICATIONS

Search Report dated Oct. 26, 2018 for Chinese Patent Application No. 201610157721.2 (only the English translation is submitted).

(Continued)

*Primary Examiner* — Rakesh B Patel
(74) *Attorney, Agent, or Firm* — FisherBroyles, LLP

(57) ABSTRACT

A filter apparatus includes a filter body including one or more resonator cavities, a casing, wherein the filter body is arranged inside the casing, and at least one flexible fixing member. A first connection area of the at least one flexible fixing member is fixed to the casing and a second connection area of the at least one flexible fixing member is fixed to the filter body. The at least one flexible fixing member is made of material including at least one of metal, polymer, rubber.

11 Claims, 3 Drawing Sheets

(56) References Cited

U.S. PATENT DOCUMENTS

| | | | | |
|---|---|---|---|---|
| 2003/0058067 | A1 | 3/2003 | Wakamatsu et al. | |
| 2010/0052824 | A1* | 3/2010 | Kim | H01P 1/2053 333/232 |
| 2012/0249267 | A1 | 10/2012 | Bernhardt et al. | |

OTHER PUBLICATIONS

Office Action dated Nov. 5, 2018 in Chinese Patent Application No. 201610157721.2.
International Search Report and Written Opinion for PCT/FI2017/050181, 10 pgs., dated Jul. 21, 2017.

* cited by examiner

RADIO FREQUENCY FILTER

CROSS-REFERENCE TO RELATED APPLICATION

This application is a National Stage application of International Application No. PCT/FI2017/050181, filed Mar. 17, 2017, which is incorporated by reference herein in its entirety.

BACKGROUND

Field

This invention relates to radio frequency filters. More particularly, the present invention relates to radio frequency filter body fixing to a casing.

Description of the Related Art

Radio frequency filter may comprise a filter body and a casing for the filter body. The filter body may be mounted inside the casing.

SUMMARY

According to an aspect, there is provided the subject matter of the independent claim.

Some further embodiments are defined in the dependent claims.

BRIEF DESCRIPTION OF THE DRAWINGS

In the following the invention will be described in greater detail by means of preferred embodiments with reference to the attached drawings, in which.

DETAILED DESCRIPTION

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

The present invention describes a solution for flexible filter body mounting inside a casing. This may be beneficial to a filter apparatus performance and robustness. It may be possible to produce more agile, lighter and/or less material consuming filter apparatus by using the described invention.

Figure 1:
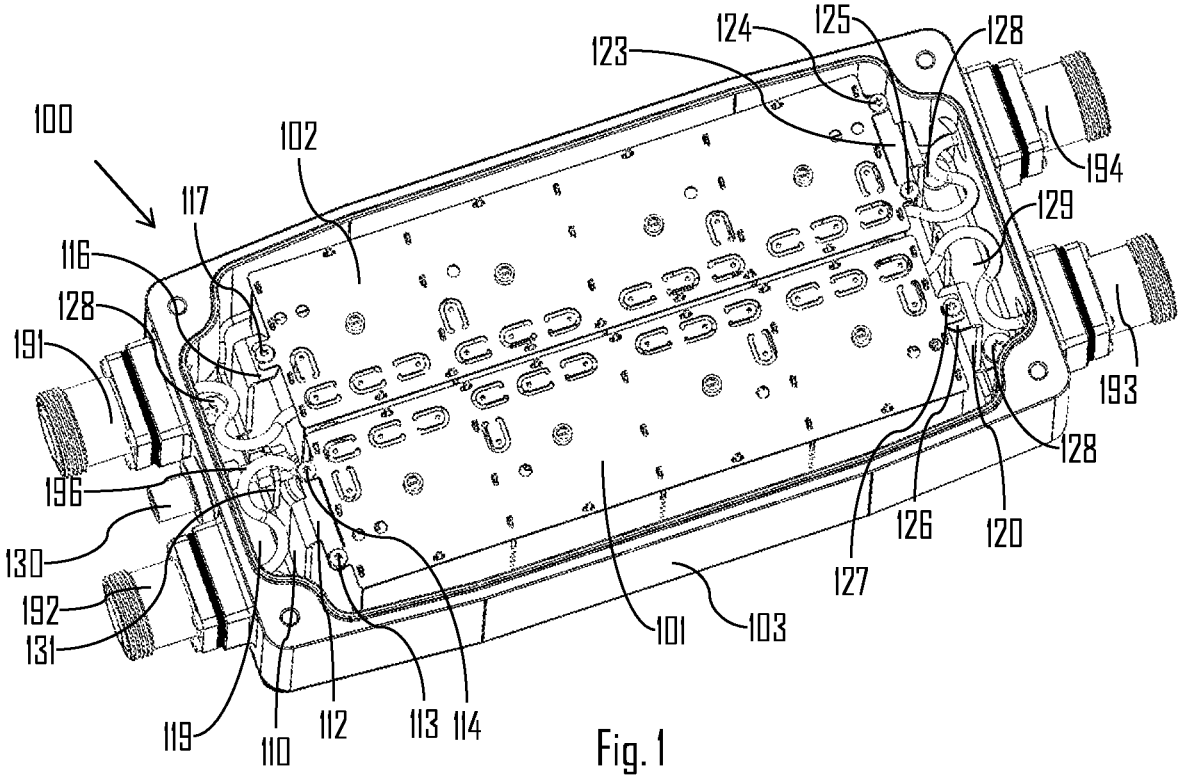
FIG. 1 illustrates a filter apparatus to which embodiments of the invention may be applied.

FIG. 1 illustrates a filter apparatus 100 to which embodiments of the invention may be applied. The filter apparatus 100 may be configured to form or comprise a radio frequency (RF) filter. The RF filter may be used in a radio transceiver such as a base station of a wireless communication system, e.g. a cellular communication system.

Referring to FIG. 1, the filter apparatus 100 may be connected to or used together with base station RF devices, such as transmitters, receivers or transceivers. RF device may be, for example, a device or a module of a base station in a cellular communication system. The filter apparatus 100 may comprise ports 191, 192, 193, 194 which may be used as signal input and/or output ports. Signal cables, such as coaxial cable, may be connected to the ports 191, 192, 193, 194. The signal cable may provide the filter a RF signal and/or a direct current (DC) signal part which can be used as operational voltage for the filter apparatus 100. The DC signal part may comprise Antenna Interface Standards Group (AISG) signal part. The filter apparatus 100 may comprise a filter body 101 comprising one or more resonator cavities. The filter apparatus 100 may further comprise a casing 103, wherein the filter body 101 may be placed inside the casing 103. The filter apparatus may further comprise at least one flexible fixing member 110, 120, wherein a first connection area 119, 129 of the at least one flexible fixing member 110, 120 is fixed to the casing 103 and a second connection area 112, 126 of the at least one flexible fixing member 110, 120 is fixed to the filter body 101. The connection may be done so that the filter body 101 is spaced at a distance from the casing 103. This may be achieved by arranging the at least one flexible fixing member 110, 120 and the connections to the casing 103 and to the filter body 101 so that there is a gap between the casing 103 and the filter body 101. In an embodiment, the filter body's 101 outer dimensions are smaller than the inner dimensions of the casing 103.

In an embodiment, the filter body 101 may somewhat physically touch the casing 103 even though the filter body 101 is substantially spaced at a distance from the casing 103.

In an embodiment, the filter body 101 is hangably attached into the casing 103 using the at least one flexible fixing member 110, 120. Thus, the filter body 101 and/or some other filter bodies may hang freely in the casing 103 without touching the casing 103.

In an embodiment, the at least one flexible fixing member 110, 120 is adapted to reduce physical connection between the filter body 101 and the casing 103. This may mean that the physical connection may happen, but the at least one flexible fixing member 110, 120 may limit the amount of energy induced, through the connection, to the filter body 101 from the casing 103.

The at least one fixing member 110, 120 may be flexible in response to external mechanical energy induced to the casing 103, thus reducing the amount of energy transferred from the casing to the filter body 101. The mechanical energy induced to the casing may be, for example, rotation force from connecting cables to the ports 191, 192, 193, 194 with a torque wrench or similar. The mechanical energy may also be induced to the casing, for example, by wind or gravity force.

The ports 191, 192, 193, 194 may be connected with the signal cables to other RF devices. An input signal may be inputted, for example, to port 192. The input signal may be deliver to the filter body by using cable 196. Similar cables may be used with ports 192, 193, 194. The output signal may be outputted from port 193, after it has passed through the filter body 101. Similarly, the input signal may be inputted to port 193 and outputted from port 192.

The casing 103 may comprise a grounding input 130 for a grounding cable, the grounding input 130 electrically coupled with the at least one flexible fixing member 110, 120, and wherein the at least one flexible fixing member 110, 120 is electrically coupled to the filter body 101. In an embodiment, the first flexible fixing member 110 comprises a grounding input, such as the grounding input 130, whereas the second flexible fixing member 120 is not connected to a grounding input.

In an embodiment, the casing 103 is made of plastic.

In an embodiment, the casing 103 is made of polyester.

In an embodiment, the casing 103 is made of metal.

In an embodiment, the casing 103 comprises bullet-proof material, such as Kevlar. This may improve robustness of the filter apparatus 100.

The at least one flexible fixing member 110, 120 may comprise a first flexible fixing member 110 and a second flexible fixing member 120, wherein a first connection area 119 of the first flexible fixing member 110 and a first connection area 126 of the second flexible fixing member 120 are fixed to the casing 103 facing each other, wherein the filter body 101 is placed between the first flexible fixing member 110 and the second flexible fixing member 120, and wherein the second connection area 112 of the first flexible connection member 110 and the second connection area 126 of the second flexible connection member 120 are fixed to the filter body 101 so that the filter body 101 is spaced at a distance from the casing 103. In an embodiment, the filter body 101 may be fixed to the first and second connection members 110, 120 from the lid of the filter body 101 such that the filter body 101 hangs in the casing from the first and the second flexible connection members 110, 120.

The filter apparatus 100 may further comprise a second filter body 102 comprising one or more resonator cavities, the second filter body 102 may be placed between the first and the second flexible fixing members 110, 120, wherein a third connection area 116 of the first flexible fixing member 110 and a third connection area 123 of the second flexible fixing member 120 are fixed to the second filter body 102. The connection may be done so that the second filter body 102 is spaced at a distance from the casing 103. In an embodiment, the second filter body 102 is spaced at a distance from the filter body 101. In an embodiment, elastic padding is inserted between the filter body 101 and the second filter body 102. In an embodiment, the casing 103 comprises elastic padding which may be inserted between the filter body 101 and the casing 103. The elastic padding may touch the filter body 101 and/or the casing 103. The elastic padding may further reduce the amount of induced mechanical energy to the filter body 101. In an embodiment, the elastic padding is inserted between the filter body 101 and the casing 103 so that the padding does not touch the filter body 101. Naturally, the elastic padding may be arranged so that it reduces the energy inflicted to the second filter body 102.

In an embodiment, the filter bodies 101, 102 at least partly touch the casing 103 directly. The filter bodies 101, 102 may further touch each other directly.

In an embodiment, the filter bodies' 101, 102 outer dimensions are smaller than the inner dimensions of the casing 103. This may allow the filter bodies 101, 102 not to substantially, or not at all touch the casing 103.

In an embodiment, the at least one flexible fixing member 110, 120 is located at least partly between the filter body 101 and the casing 103. The at least one flexible fixing member 110, 120 may be located also between the filter body 102 and the casing 103.

The at least one flexible fixing member 110, 120 may be fixed to the casing 103 from the first connection area 119, 129 of the at least one flexible fixing member 110, 120 by using fixing points 128. It may be noted that not all fixing points 128 may be visible in FIG. 1. The first connection area 119, 129 of the at least one fixing member 110, 120 may comprise holes which may correspond to holes comprised in the casing 103. Screws or similar fixing members may be used to fix the at least one flexible fixing member 110, 120 to the casing 103 by inserting the screws through the said holes of at least one flexible fixing member 110, 120 and the casing 103. In an embodiment, the fixing screws comprise elastic material (e.g. rubber) under the screw's base. Similar fixing, as described above, may be used to fix other connection areas, such as second and third connection areas 112, 126 and 116, 123 of the at least one flexible fixing member 110, 120 to the filter bodies 101, 102. In an embodiment, the at least one of the above described fixing points comprise an elastic padding (e.g. rubber). The fixing point may comprise the hole and/or the screw describe above. The elastic padding may reduce the amount of energy induced from the casing 103 to the filter bodies 101, 102. The elastic padding may be a rubber ring placed around the hole and/or the screw, for example.

The second connection area 112 of the first flexible fixing member 110 may be fixed to the filter body 101 by fixing points 113, 114. The third connection area 116 of the first flexible fixing member 110 may be fixed to the second filter body 102 by fixing point 117. The second connection area 126 of the second flexible fixing member 120 may be fixed to the filter body 101 by fixing point 127. The third connection area 123 of the second flexible fixing member 120 may be fixed to the second filter body 102 by fixing points 124, 125.

In an embodiment, the second connection area 112 of the first flexible connection member 110 is fixed to the filter body 101 with two separate fixing points 113, 114, and the second connection area 126 of the second flexible connection member 120 is fixed to the filter body 101 with one fixing point 127.

In an embodiment, the third connection area 116 of the first flexible connection member 110 is fixed to the second filter body 102 with one fixing point 117, and the third connection area 123 of the second flexible connection member 120 is fixed to the second filter body 102 with two separate fixing points 124, 125.

In an embodiment, the filter body 101 and the second filter body 102 are placed adjacent each other. In some embodiments, the filter bodies 101, 102 may be placed in the casing 103 on top of each other. In some embodiments, there may be some filter bodies adjacent to each other, and some filter bodies on top of each other. For example, two adjacent filter body pair may be arranged on top of each other. The filter bodies may be arranged such that they do not touch each other. There may be different at least one flexible fixing members for each layer.

In an embodiment, the first connection area 119, 129 of the at least one flexible fixing member 110, 120 is situated in the first end of the at least one flexible fixing member 110, 120, and the second connection area 112, 126 of the at least one flexible fixing member 110, 120 is situated in the second end of the at least one flexible fixing member 110, 120.

Similarly, the third connection area 116, 123 may be located in the third end of the at least one flexible fixing member 110, 120.

In an embodiment, the filter body 101 is fixed to the casing 103 with a 3-point fixing. The 3-point fixing may refer to the fixing points used to connect the filter body 101 to the at least one flexible fixing member 110, 120. The 3-point fixing may protect the filter body 101 from external mechanical energy. The 3-point fixing may reduce the filter body 101 bending if, for example, a coaxial cable is connected to the port 192, or some other port, with a torque wrench. The rotating force induced to the filter body 101, by connecting the coaxial cable, may decrease as the 3-point fixing may reduce the amount of induced rotation energy. Moreover, the 3-point fixing may reduce the amount of energy induced to the filter body 101 from the side where the filter body 101 is connected with one fixing point to the at least one flexible fixing member 110, 120. Another advantage of the 3-point fixing, as described before, is that it may allow mounting of the filter body 101 to the casing 103 only in one way, thus reducing the risk of false installation. In an embodiment, the filter bodies 101, 102 are both fixed with 3-point fixing.

In an embodiment, the filter body 101 is fixed to the casing 103 with more than three fixing points providing a more stable mounting.

In an embodiment, the at least one flexible fixing member 110, 120 may comprise a third flexible fixing member used to secure at least one of the filter bodies 101, 102 to the casing 103.

In an embodiment, input signal comprises RF part and AISG/DC part.

In an embodiment, the DC/AISG part of the input signal passes through the filter apparatus 100 without breaking the filter apparatus 100.

In an embodiment, the filter apparatus 100 is a band-pass filter.

In an embodiment, the filter apparatus 100 is a low-pass filter or a high-pass filter.

In an embodiment, the filter apparatus 100 comprises two or more filter bodies, such as filter bodies 101, 102.

Figure 2:
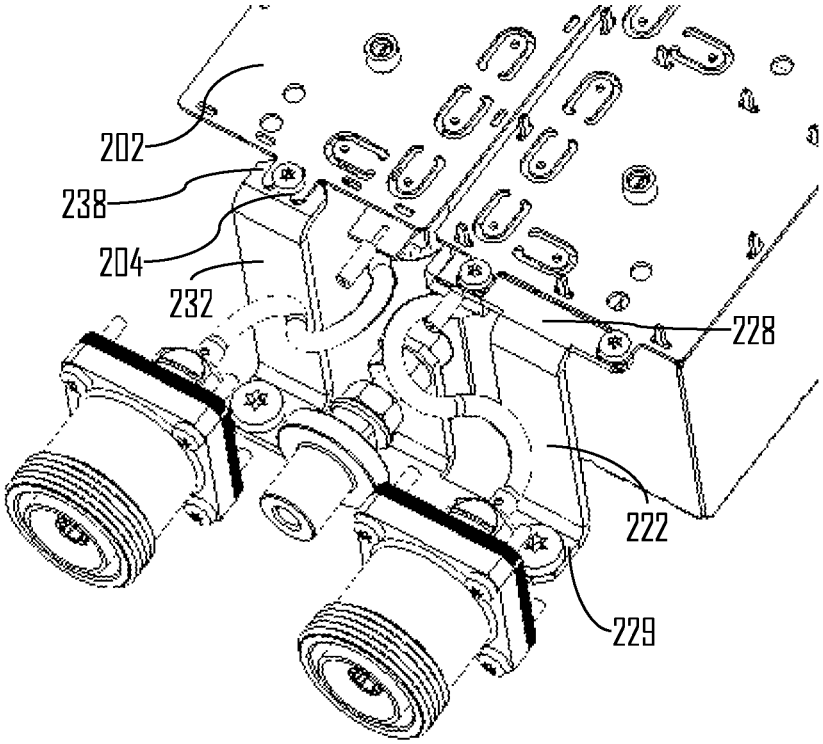
FIG. 2 illustrates fixing of filter bodies according to an embodiment of the invention.

Let us now take a closer look of the at least one flexible fixing member 110, 120. FIG. 2 illustrates fixing of filter bodies, such as filter bodies 101, 102, according to an embodiment of the invention. Referring to FIG. 2, a flexible fixing member, such as the at least one flexible fixing member 110, 120, may comprise a bottom part 229, a bar 222 and a top part 228. The bottom part 229 may comprise the first connection area, such as first connection areas 119, 129 of FIG. 1. The top part 228 may comprise the second and/or the third connection areas 112, 116, 126, 123 of FIG. 1. The bar 222 may provide the said flexible fixing member elasticity by bended ends which connect to the bottom part 229 and the top part 230. In an embodiment, the bar 222 is connected to the bottom part 229 and the top part 228 so that the connection angle is about 90 degrees. In an embodiment, the bottom part 229, the bar 222 and the top part 228 are made of one single object. The said flexible fixing member may also be produced out of multiple separate parts connected together. The said flexible fixing member may be made of, for example, stainless steel or other electricity conducting metal. The said flexible fixing member may have other bottom parts, bars and top parts similar to the bottom part 229, the bar 222 and the top part 228. In an embodiment, the said flexible fixing member is the fixing member 110 of FIG. 1, wherein the bottom part 229 comprises the first connection area 119 and the top part 228 comprises second connection area 112. The said flexible fixing member may comprise a second bar 232 and a second top part 238. The second top part 238 may comprise the third connection area 116 of FIG. 1. In an embodiment, the said flexible fixing member may be of on single integral part.

The flexible fixing member of FIG. 2 may be used to fix filter bodies to the surrounding casing, such as casing 103, as described above. The filter bodies, such as filter bodies 101, 102 of FIG. 1, may comprise a lid 202 comprising a protrusion 204 with a hole which is used to connect the said flexible fixing member to the filter body. The hole may be of closed type. In an embodiment the hole of protrusion 204 is open from one side, thus enabling easier mounting of the filter body to the said flexible fixing member. In an embodiment, the second top part 238 of the said flexible fixing member is fixed to the protrusion 238, wherein the fixing hole in the protrusion 204 is open from one side. The top part 228 may be connected to another filter body with two protrusions. The two protrusions may comprise a hole each which may be closed type. The said holes may be used to fix the said filter body to the said flexible fixing member.

The flexible fixing member may be flexible in various directions. It may flex towards the lid 202 which may be comprehended as up-direction. Naturally, the reversed direction of the flexing can be comprehended as down-direction. Flexing up and down may be comprehended as vertical flexing. Similarly, horizontal flexing may happen, which may include back and forth flexing and flexing to the sides. Back and forth flexing may happen to the direction of the filter body and away from the filter body. Flexing to the sides may be parallel with the fixing edge of the filter body.

Figure 4:
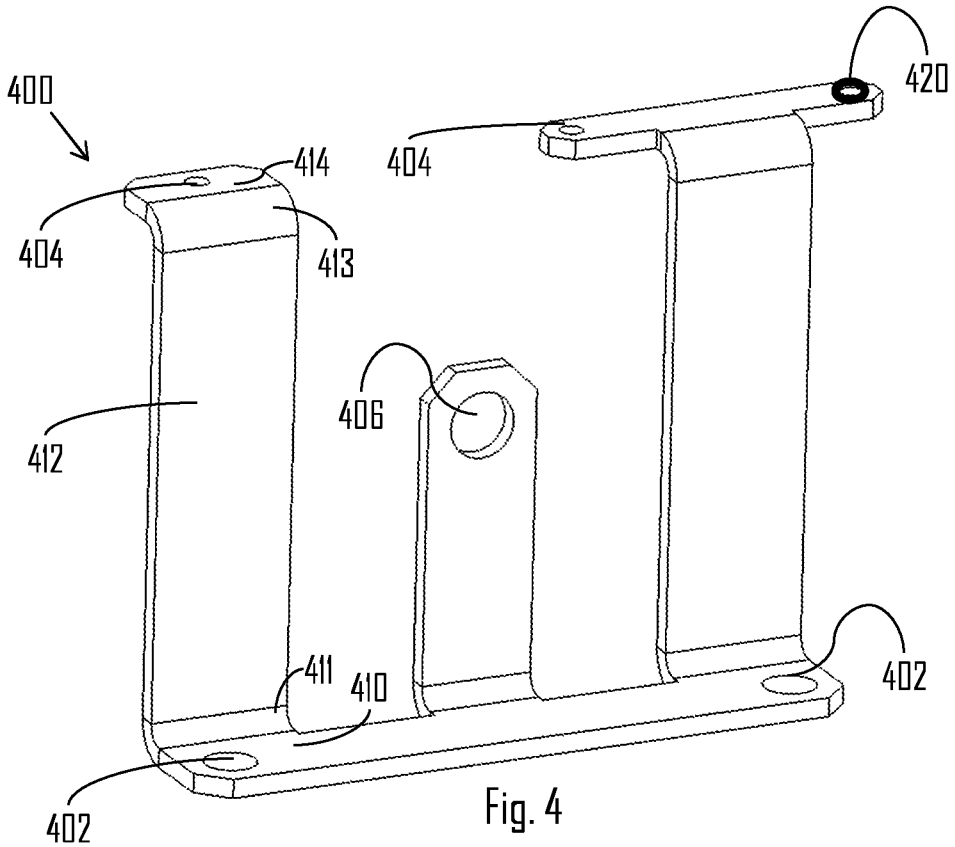
FIG. 4 illustrates a flexible fixing bracket according to an embodiment of the invention.

In an embodiment, the at least one flexible fixing member comprises an anti-vibration bracket. Example of such anti-vibration bracket is shown in FIG. 4 which is later described in more detail.

In an embodiment, the at least one flexible fixing member comprises a spring. The at least one flexible fixing member may comprise other elastic or bendable objects, such as foam and/or electromechanical devices arranged to absorb shock and/or vibration.

In an embodiment, the said flexible fixing member is connected to a filter body, such as filter bodies 101, 102, from bottom of the filter body.

In an embodiment, the at least one flexible fixing member 110, 120 is connected to one filter body, such as the filter body 101, from the lid and to another filter body, such as the second filter body 102, from the bottom of the filter body.

In an embodiment, the casing 103 comprises fastening means for fastening the casing to an external object. The external object may be a radio tower and/or some other structure, for example. The casing 103 may be fixed to other devices, such as base stations and/or RF devices. The fixing may be done by using fixing points, for example. The fixing points may comprise holes, screws, bolts and/or elastic paddings. The elastic paddings may reduce the amount of induced external energy to the casing 103.

Figure 3A:
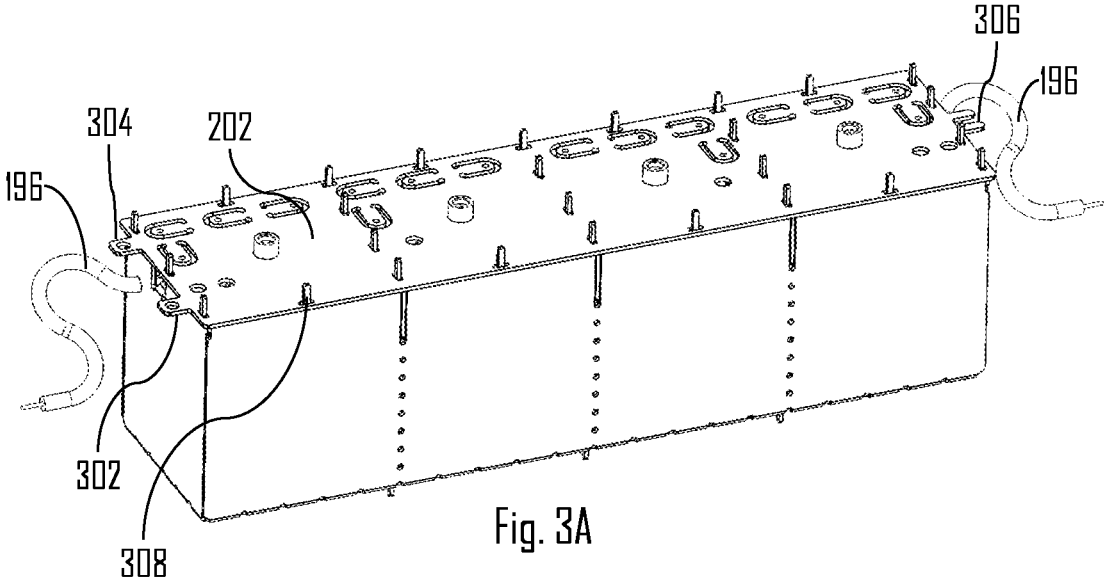
FIG. 3A illustrates a filter body according to an embodiment of the invention.

FIG. 3A illustrates a filter body, such as filter bodies 101, 102 of FIG. 1, according to an embodiment of the invention. Referring to FIG. 3A, the cables 196 may be used to transfer a filter body input signal or a filter body output signal. Input signals to the cable 196 may be provided by the ports 191, 192, 193, 194 as described above. In a similar way, the output signals may be outputted from the cables 196 to the ports 191, 192, 193, 194. The filter body may comprise bottom plate, side walls and a lid 202. The filter body may further comprise cavity walls forming cavities inside the filter body. The lid 202 may comprise protrusions 302, 304, 306. These protrusions may be protrusion 204 of the FIG. 2 or similar. The protrusions may comprise a hole which may be used to connect the flexible fixing member, such the at least one flexible fixing member 110, 120 of FIG. 1. The holes may have counterparts or counter-holes in the said flexible fixing member which may enable fixing. The fixing may be achieved by inserting a screw through the corresponding holes of the said flexible fixing member and the said holes. Other similar fixing means may be used which may include, for example, clue. The filter body may have one or more mounting aids 308 which may help the installation of the lid 202 to the filter body. The one or more mounting aids 308 may comprise a hole in the lid 202 and counterparts protruding through the hole. The one or more mounting aids 308 may keep the lid 202 stable for a more secure fixing of the lid 202 to the side walls. The said fixing may be done, for example, by welding the bottom plate, side walls and the lid 202 together.

Figure 3B:
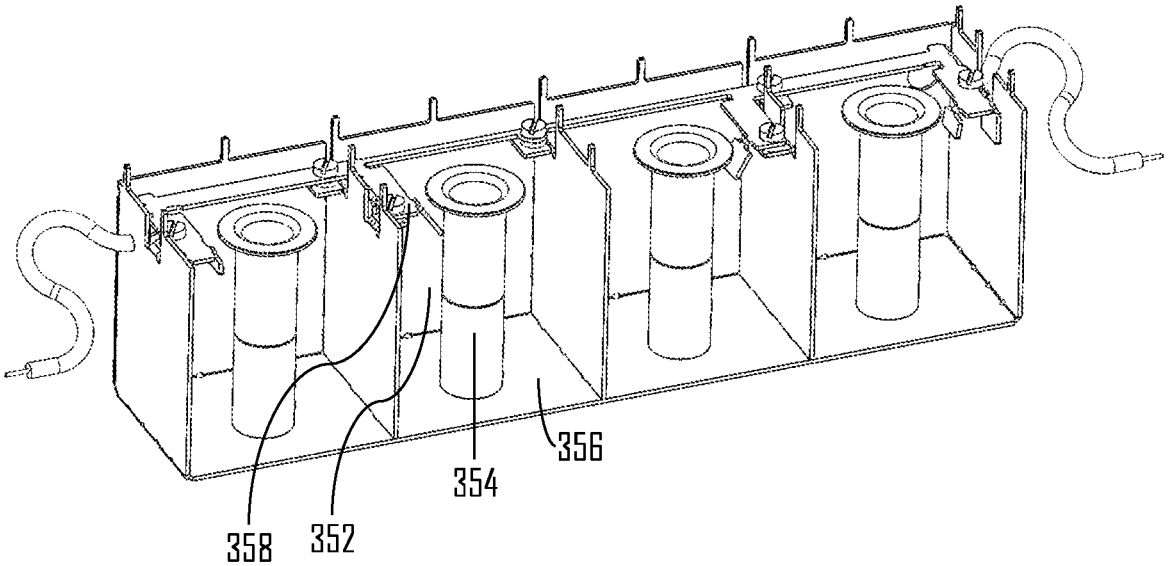
FIG. 3B illustrates a filter body according to an embodiment of the invention.

FIG. 3B illustrates a filter body according to an embodiment of the invention. The said filter body may be, for example, the filter body of FIG. 3A wherein one of the side walls and lid 202 has been removed. Referring to FIG. 3B, the filter body may comprise one or more resonator cavities. Let us now take a closer look on one of the resonator cavities. The resonator cavity may comprise a cavity 352 and a resonator rod 354. The resonator rod 354 may be inductively connected to the bottom plate of the filter body. The filter body may be grounded as described in FIG. 1 by a grounding input 130. The resonator rod 354 may be capacitively connected at least to a lid, such as the lid 202 of FIG. 3A, of the filter body. The resonator rod may also be capacitively connected to a transmission line 358 which may be capable for transmitting a signal from the cables, such as cables 196 of FIG. 3A, through the filter body.

In an embodiment, the filter body 101 is hanging from the at least one flexible fixing member 110, 120. The filter body 101 may be fixed to the at least one flexible fixing member 110, 120 so that it hangs inside the casing 103.

In an embodiment, the filter body 101 is supported by the at least one flexible fixing member 110, 120. This may mean that the at least one flexible fixing member 110, 120 is arranged to provide supporting force to the filter body 101. The at least one flexible fixing member 110, 120 may, for example, be fixed to the filter body 101 from the bottom of the filter body 101 to produce a supporting force. The supporting force may be a counter-force for gravity force. In an embodiment, the filter body 101 is laid on the at least one flexible fixing member 110, 120.

FIG. 4 illustrates a bracket 400 according to an embodiment of the invention. The bracket 400 may be comprised in the at least one flexible fixing member 110, 120 of FIG. 1. In an embodiment, the at least one flexible fixing member 110, 120 is the bracket 400. In an embodiment, the bracket 400 is an elastic bracket. Referring to FIG. 4, the bracket 400 may comprise one or more holes 402 which may be used to connect the bracket to surrounding casing, such as the casing 103 of FIG. 1. The bracket 400 may further comprise one or more holes 404 which can be used to connect one or more filter bodies, such as filter bodies 101, 102 of FIG. 1, to the bracket 400. The bracket 400 may further comprise a coupling gap 406 for a grounding cable or a grounding metal rod. The coupling gap 406 may reside in a protrusion of the bracket 400, for example. The bracket 400 may comprise one or more elongated arms of which one is shown in FIG. 4 with numbers 411-414. One end of the elongated arms may mechanically be connected to a bottom plate 410 of the bracket 400. The bracket 400 may comprise more than one bottom plates 410 which may be connected to a number of elongated arms 411-414. The elongated arms 411-414 and the bottom plate 410 may be of one integral part. The bracket 400 may flex when mechanical force is induce to it. The part 414 may flex, for example, up and down and to the sides. The part 412 may flex, for example, back and forth and to the sides. Therefore a 3-dimensional flexing may be achieved. The bent parts 411, 413 may further enhance the flexing force. The flexing force may resist the mechanical energy or mechanical force, thus providing a counterforce to the induced mechanical energy or mechanical force.

The bracket 400 may further comprise one or more elastic paddings 420. These elastic paddings 420 may be used to reduce the amount of energy induced form the casing 103 to the filter bodies 101, 102. As described above, the elastic paddings 420 may be comprised in at least one of the fixing points used to fix the casing 103 and/or the filter bodies 101, 102 to the bracket 400. The elastic padding 420 may be fitted on top of a hole and/or inside the hole, such as the holes 402 and/or the holes 404. In an embodiment, the elastic padding 420 is fixed to a screw used for fixing together with the holes 402, 404. Although the one or more elastic paddings 420 are shown in FIG. 4 with only one elastic padding 420, each of the fixing points may comprise similar elastic paddings as elastic padding 420.

In an embodiment, the bracket 400 flexes both horizontally and vertically. The bracket 400 may return to its original form and position after the force induced to the casing, such as casing 103 of FIG. 1, diminishes.

In some embodiments, the at least one flexible fixing member is referred to as at least one elastic fixing member. For example, the flexible fixing member 110 may be an elastic fixing member 110. In some embodiments, the elasticity of the fixing member may increase the shock-absorption ability of said fixing member. Elasticity of the flexible fixing member (or consequently the elastic fixing member) may be increased by choosing more elastic material or by selecting a shape of the flexible fixing member that produces elasticity (e.g. a bow-like structure).

In an embodiment, the at least one flexible fixing member 110, 120 comprises metal. For example, iron, steel, and/or aluminium may be used. Using metal in the at least one flexible fixing member may bring good elastic and/or flexibility features, and further provide a possibility for electrically connect said fixing member to one or more inputs and/or outputs (e.g. grounding). In an embodiment, the at least one flexible fixing member 110, 120 is made of metal.

In an embodiment, the at least one flexible fixing member 110, 120 is made of material comprising metal, polymer and/or rubber. Polymers may comprise, for example, plastics of different kinds. For example, a polymer having desired flexible and/or elastic properties may be chosen.

In an embodiment, at least one of the first filter body 101, the second filter body 102 is made of material comprising metal. For example, walls, bottom, and/or the lid may be made of metal, such as steel.

In an embodiment, the at least one flexible fixing member 110, 120 has a thickness of at least 0.05 cm. In an embodiment, the at least one flexible fixing member 110, 120 has a thickness of at least 0.1 cm. In an embodiment, the at least one flexible fixing member 110, 120 has a thickness of at least 0.2 cm. In an embodiment, the at least one flexible fixing member 110, 120 has a thickness of at least 0.5 cm. In an embodiment, the at least one flexible fixing member 110, 120 has a thickness between 0.1 cm and 1 cm. Such dimensions may be beneficial in providing a solid fixing but also enough flexibility and/or elasticity for the shock-absorption.

In an embodiment, the casing 103 has a wall-thickness of at least 0.1 cm. In an embodiment, the casing 103 has a wall-thickness of at least 0.5 cm.

In an embodiment, the casing 103 has a wall-thickness of between 0.1 cm and 1 cm.

In an embodiment, the first filter body 101 and/or the second filter body 102 has a wall-thickness of at least 0.1 cm. For example, the wall-thickness may be between 0.1 cm and 1 cm. In some embodiments, the filter body 101 and/or the second filter body 102 are dimensioned such that they bend when external force is inflicted to the casing. For example, when an input cable is attached, the ability to bend may further decrease the amount of energy inflicted on the resonators in the filter bodies. This may increase robustness of the filter apparatus 100.

In an embodiment, the at least one flexible fixing member 110, 120, first filter body 110, second filter body 120, and/or the casing 103 comprises a welded portion and/or a soldered portion. For example, the filter bodies 110, 120 may be more easily manufactured when they are welded or soldered together from two or more subparts. For example, there may be one soldered portion and another welded portion or only one of the mentioned connecting means.

In an embodiment, the first filter body 110, and/or the second filter body 120 comprises a bended portion. For example, the filter bodies 110, 120 may be more easily manufactured when they are bent from a larger metal sheet or plate. Combining bended parts and welding may be especially beneficial in some embodiments. That is, for example, the first filter body 110 may comprise at least two subparts from which at least one of them comprises a bended portion, and wherein the at least two subparts are welded together.

It needs to be noted that some embodiments of the invention above are introduce using, for example, filter body 101 as an example. Naturally, these embodiments may be applicable to filter body 102 or some other filter body as well. Furthermore, the filter apparatus 100 may comprise more than two filter bodies 101, 102 in some embodiments. For example, three, four or more filter bodies may be comprised in the filter apparatus 100.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

What is claimed is:

1. A filter apparatus comprising:

a filter body comprising one or more resonator cavities;

a casing, wherein the filter body is arranged inside the casing; and at least one flexible fixing member, wherein a first connection area of the at least one flexible fixing member is fixed to the casing and a second connection area of the at least one flexible fixing member is fixed to the filter body, and wherein the at least one flexible fixing member is made of a material comprising at least one of a metal, a polymer, and a rubber, the at least one flexible fixing member comprising a first flexible fixing member and a second flexible fixing member, wherein the filter body is fixed to the casing with a 3-point fixing such that the first connection area of the first flexible fixing member and the first connection area of the second flexible fixing member are fixed to the casing to face each other, wherein the filter body is arranged between the first flexible fixing member and the second flexible fixing member, and such that the second connection area of the first flexible fixing member is fixed to the filter body with two separate fixing points and the second connection area of the second flexible fixing member is fixed to the filter body with one fixing point, wherein the casing comprises a grounding input for a grounding cable, the grounding input electrically coupled with the at least one flexible fixing member, and wherein the at least one flexible fixing member is electrically coupled to the filter body.

2. The filter apparatus of claim 1, wherein the at least one flexible fixing member is arranged so that the filter body is spaced at a distance from the casing.

3. The filter apparatus of claim 1, wherein the first connection area of the at least one flexible fixing member is arranged in a first end of the at least one flexible fixing member, and the second connection area of the at least one flexible fixing member is arranged in a second end of the at least one flexible fixing member.

4. The filter apparatus of claim 1, wherein the casing has a wall-thickness of at least 0.1 cm.

5. The filter apparatus of claim 1, wherein the filter body is made of material comprising metal.

6. The filter apparatus of claim 1, wherein said filter body is a first filter body, wherein the filter apparatus further comprises a second filter body comprising one or more resonator cavities, the second filter body arranged between the first and the second flexible fixing members, wherein a third connection area of the first flexible fixing member and a third connection area of the second flexible fixing member are fixed to the second filter body.

7. The filter apparatus of claim 6, wherein the first filter body and the second filter body are placed adjacent to each other.

8. The filter apparatus of claim 6, wherein the first flexible fixing member and the second flexible fixing member are arranged so that the first filter body and the second filter body are spaced at a distance from the casing.

9. The filter apparatus of claim 6, wherein the third connection area of the first flexible fixing member is fixed to the second filter body with one fixing point, and wherein the third connection area of the second flexible fixing member is fixed to the second filter body with two separate fixing points.

10. A filter apparatus comprising:

a filter body comprising one or more resonator cavities;

a casing, wherein the filter body is arranged inside the casing; and at least one flexible fixing member, wherein a first connection area of the at least one flexible fixing member is fixed to the casing and a second connection area of the at least one flexible fixing member is fixed to the filter body, and wherein the at least one flexible fixing member is made of a material comprising at least one of a metal, a polymer, and a rubber, the at least one flexible fixing member comprising a first flexible fixing member and a second flexible fixing member, wherein the filter body is fixed to the casing with a 3-point fixing such that the first connection area of the first flexible fixing member and the first connection area of the second flexible fixing member are fixed to the casing to face each other, wherein the filter body is arranged between the first flexible fixing member and the second flexible fixing member, and such that the second connection area of the first flexible fixing member is fixed to the filter body with two separate fixing points and the second connection area of the second flexible fixing member is fixed to the filter body with one fixing point, wherein at least one of the fixing points comprises an elastic padding.

11. A filter apparatus comprising:

a filter body comprising one or more resonator cavities;

a casing, wherein the filter body is arranged inside the casing; and at least one flexible fixing member, wherein a first connection area of the at least one flexible fixing member is fixed to the casing and a second connection area of the at least one flexible fixing member is fixed to the filter body, and wherein the at least one flexible fixing member is made of a material comprising at least one of a metal, a polymer, and a rubber, the at least one flexible fixing member comprising a first flexible fixing member and a second flexible fixing member, wherein the filter body is fixed to the casing with a 3-point fixing such that the first connection area of the first flexible fixing member and the first connection area of the second flexible fixing member are fixed to the casing to face each other, wherein the filter body is arranged between the first flexible fixing member and the second flexible fixing member, and such that the second connection area of the first flexible fixing member is fixed to the filter body with two separate fixing points and the second connection area of the second flexible fixing member is fixed to the filter body with one fixing point, wherein the at least one flexible fixing member comprises an anti-vibration bracket.

* * * * *